US007540040B2

(12) United States Patent
Roenick

(10) Patent No.: US 7,540,040 B2
(45) Date of Patent: Jun. 2, 2009

(54) BEDSIDE CARE UNIT

(76) Inventor: Harry A. Roenick, 2200 Toniwood La., Palm Harbor, FL (US) 34685

( * ) Notice: Subject to any disclaimer, the term of this patent is extended or adjusted under 35 U.S.C. 154(b) by 439 days.

(21) Appl. No.: 11/329,251

(22) Filed: Jan. 11, 2006

(65) Prior Publication Data

US 2006/0156462 A1 Jul. 20, 2006

(51) Int. Cl.
*E03D 11/00* (2006.01)

(52) U.S. Cl. ..... 4/254; 4/664

(58) Field of Classification Search ..... 4/254, 4/664

See application file for complete search history.

(56) References Cited

U.S. PATENT DOCUMENTS 6,158,060 A * 12/2000 Wheeler ..... 4/254
6,643,865 B2 * 11/2003 Bork et al. ..... 4/664
7,007,318 B1 * 3/2006 Bork et al. ..... 4/664

* cited by examiner

*Primary Examiner*—Charles E Phillips
(74) *Attorney, Agent, or Firm*—W. Warren Taltavull; Manelli Denison & Selter PLLC

(57) ABSTRACT

A toilet seat cover and back support includes a hinge connecting the back support to the rear of the toilet bowl cover and a guide is provided in the cabinet for the seat cover to maintain the back support in an upright position when the seat cover is lowered.

11 Claims, 8 Drawing Sheets

BEDSIDE CARE UNIT

FIELD OF THE INVENTION

The present invention relates to a patient care unit and one that is particularly suited for installation and use in a confined space such as a hospital or similar type of care institution. Use in mobile care equipment in military or rescue operations is also feasible where floor space is restricted.

BACKGROUND OF THE INVENTION

With rising medical costs, it has become the practice in construction of patient care buildings to reduce the floor space afforded each patient and this is likely to become the prevalent practice particularly where local or state governments are funding the structure. While different considerations may apply to military or rescue equipment, space restrictions are likely to apply since overall weight reduction is desired in such equipment such as medical trailers and the like.

In the case of elderly patients who are substantially bed ridden for most of the time as well as other patients who have difficulty moving about, it has also been the practice to assign such patients to rooms that are equipped with lavatory and toilet units to both accommodate the patient's needs and to lessen the work of the caretakers and nurses assigned to such patients. Where the room floor space is reduced for economic or other reasons, installation and use of such units have given rise to designs that both afford facilities for the patient's needs and compensate for the reduction in room size. Such designs are exemplified in U.S. Pat. No. 3,829,906, No. 6,158,060, No. 6,637,049 and Design Pat. No. 333,621. The structures shown in several of these patents have the common features of providing a washing sink and a cover for the toilet bowl in addition to the usual bowl lid where the cover is movable to a stored position when access to the bowl is required and to a lowered position where the cover may function as a seat for an attendant, the patient or a guest of the patient.

As a result of statutory enactment of regulations imposing restrictions on facilities in terms of access by disabled persons such as those confined to wheel chairs, many of these designs can no longer be installed. For example, the height of the sink upper edge must now be at a fixed distance above the floor to enable a person in a wheel chair access to the sink and water faucets (see Americans with Disabilities Act of 1990).

SUMMARY OF THE INVENTION

This invention provides a modification to the care units now available that include both a sink and faucet and a toilet bowl equipped with a seat cover and which allows a disabled person access to the sink and also permits the seat cover to be pivoted from a stored position to a covering position over the lid of the toilet bowl. The cabinet of the unit has an upper surface in which the sink is installed and the portion of this surface about the sink is lowered to provide easy access to a wheel chair confined person. Typically, sinks and associated counter tops or surfaces are manufactured with a height of about 36 or more inches. With the design of the present invention, this height may be lowered to 34 inches or even lower without interfering with the operation of the bowl cover pivot action and its associated back panel. This is achieved in one form by forming the counter surface with a protruding, arcuate portion to allow the cabinet in the vicinity of the cover to receive the cover and its front edge in a recess provided for that purpose when the cover is moved to its stored position in the cabinet. In another form of the invention, a portion of counter surface is pivotable out of the path of the lifted bowl cover. Further, in either form of the invention, a cover lifting and lowering device is mounted in the cabinet and is actuated by a readily accessible foot switch.

The foregoing and other advantages of this invention will become apparent when consideration is given to the following description and accompanying drawings in which:

DETAILED DESCRIPTION OF THE INVENTION

Figure 1:
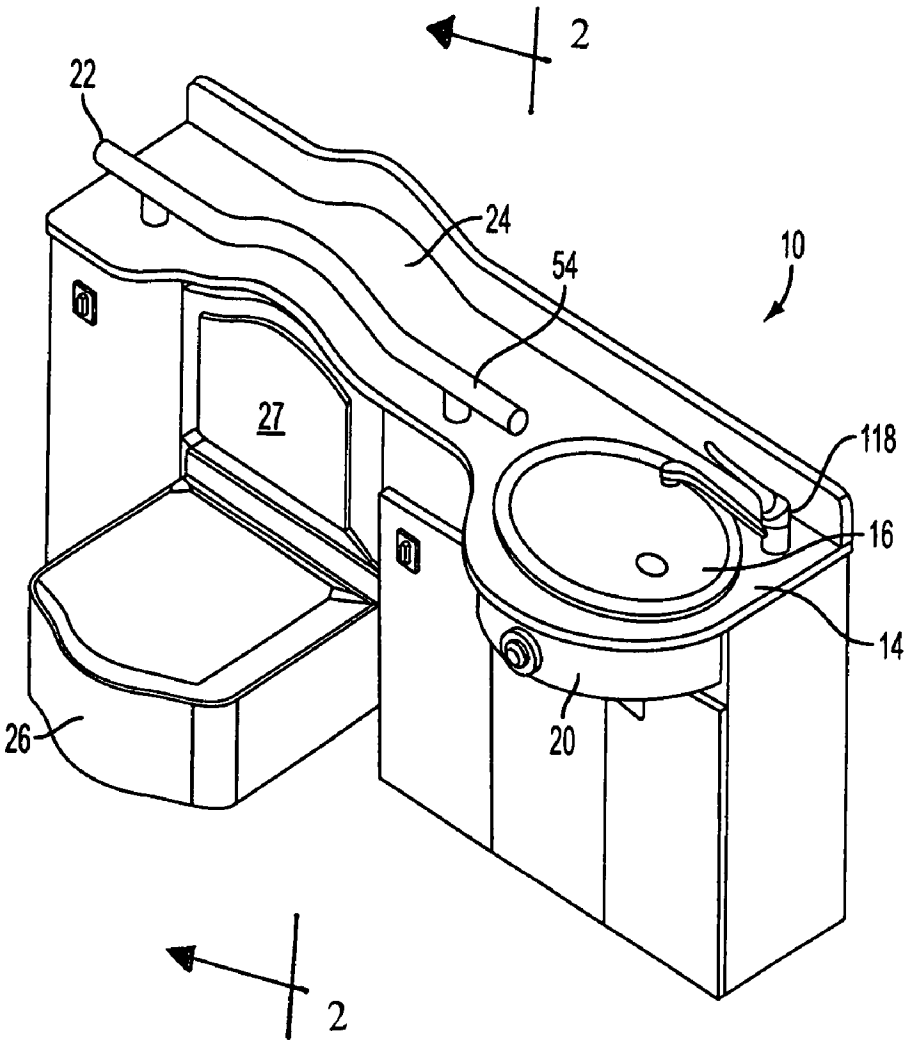
FIG. 1 is a perspective view of the care unit of this invention.
Figure 2:
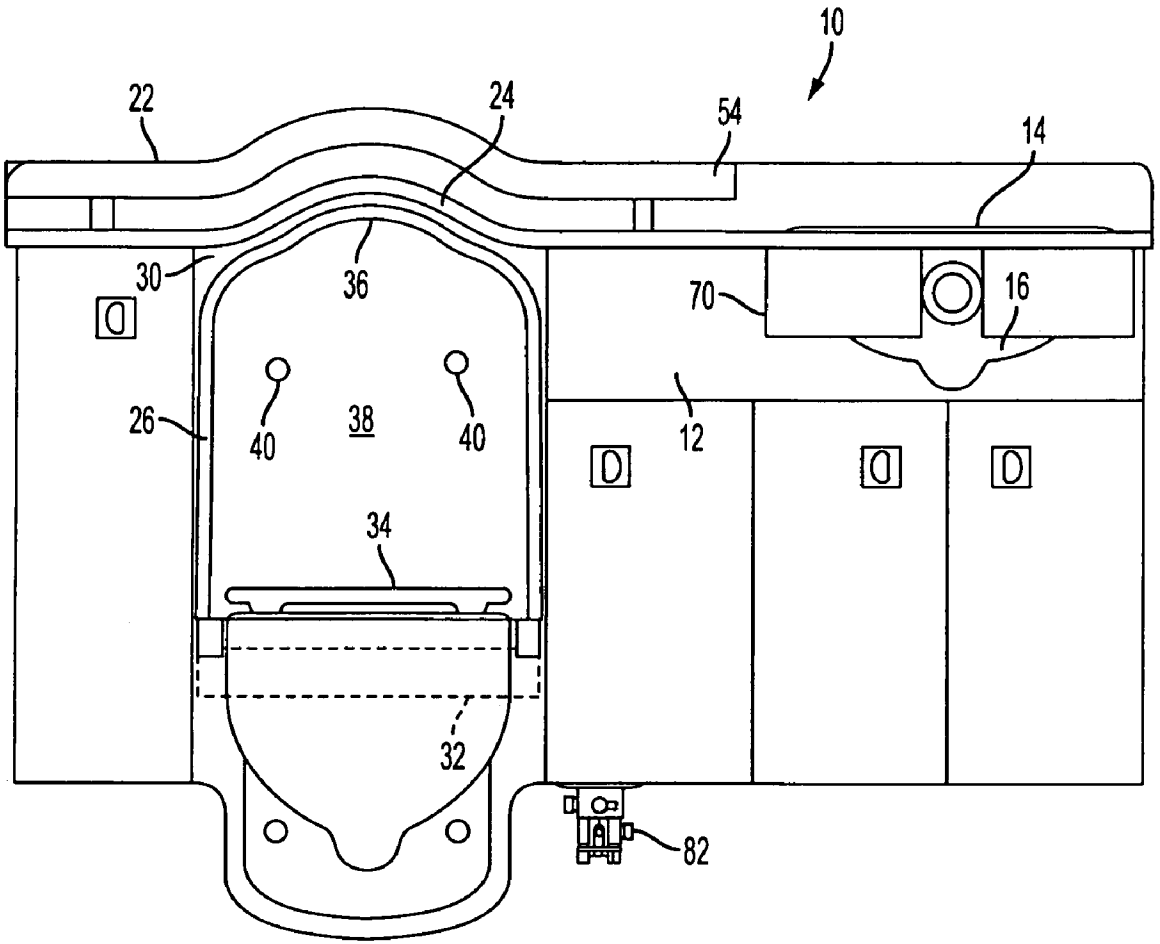
FIG. 2 is a front elevational view of the unit with the cover in its up position and, in broken lines, in its lowered position.

Referring to the drawings, there is shown in FIGS. 1 and 2, respectively, perspective and front views of the cabinet unit 10 of the present invention. As presently manufactured, the unit 10 is designed to be installed over an existing toilet bowl 32, which is provided with a conventional toilet seat 34, pivotally attached to the top of the bowl 32 in the usual manner. The unit 10 is provided with a support cabinet 12, on which is fixed a counter surface 14 including a sink 16 installed in an opening formed in the counter 14 as is the faucet implement 18. To accommodate wheelchair users, the sink protrudes a selected distance from the front face of the cabinet 12 as shown in FIG. 1.

Due to floor area limitations, a cover seat 26 is provided in the unit 10, which will cover the toilet bowl and thus be able to accommodate a guest or a worker where there is little or no floor space in the room for a regular chair. To improve the appearance of the unit 10, a movable back panel 27 is provided, which is coupled to the cover, as described below, so as to be shifted out of its forward position as shown in FIG. 1 when the cover seat 26 is raised to allow access to the toilet bowl. To allow movement of the cover seat 26 into the cabinet unit 10, a recess 30 is provided in the cabinet portion of the unit 10 of a size to allow full reception of the cover seat 26 and operation of the hinged back panel 27. However, since in many instances, the unit 10 will be installed over an existing toilet bowl 32, the size of the cover 26 cannot be altered, so as to allow full retraction of the cover seat 26. The cost of replacing the plumbing facilities will make the provision of a care unit unlikely. The present invention provides a protrusion 24 by curving the counter portion 14 upwardly in the vicinity of the recess 30. The degree of curvature of the protrusion 24 will be dictated largely by the height limitation on the surface of the counter 14 required to allow sufficient clearance for the cover seat 26. Where a conventional counter is typically positioned about 36 inches above the floor, to accommodate a wheel chair user, the upper edge of the sink 16 should be lowered to a height of from about 34 inches above the floor. It will be understood that these dimensions are merely exemplary.

As shown in FIG. 2, the cover seat 26 is in the up position which is achieved by pivoting about its hinge described below. In the up position, the cover seat 26 may have its upper end curved as at 36 to nest within the under surface of the protrusion 24. The interior surface 38 of the cover seat 26 may be provided with levelers 40, which may be adjustable to provide a level seating area when the cover 26 is in its down position as shown in FIG. 1. The levelers 40 will engage the upper surface of the toilet bowl seat 34 to provide the necessary support.

Figure 3:
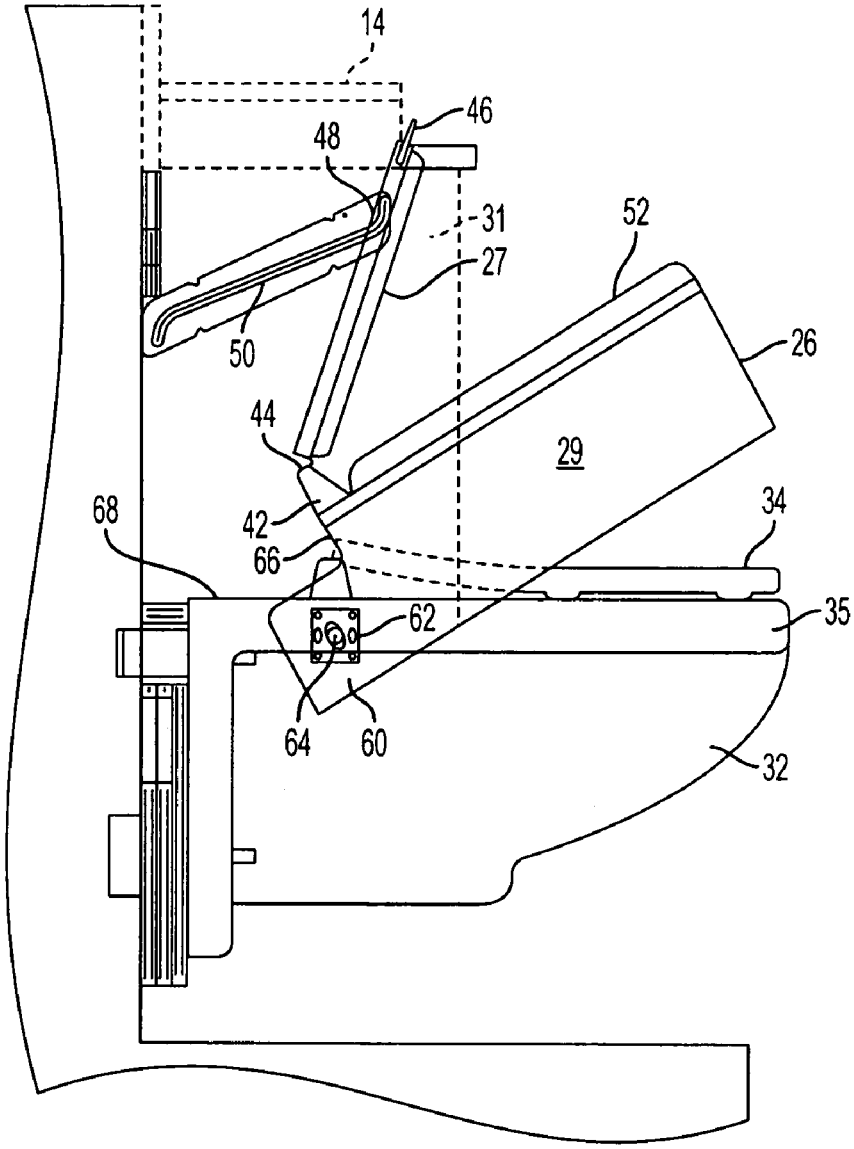
FIG. 3 is a partially sectional view through lines 2-2 of FIG. 1 with the cover in a partially up position and the bowl seat in a lowered position in solid lines.
Figure 4:
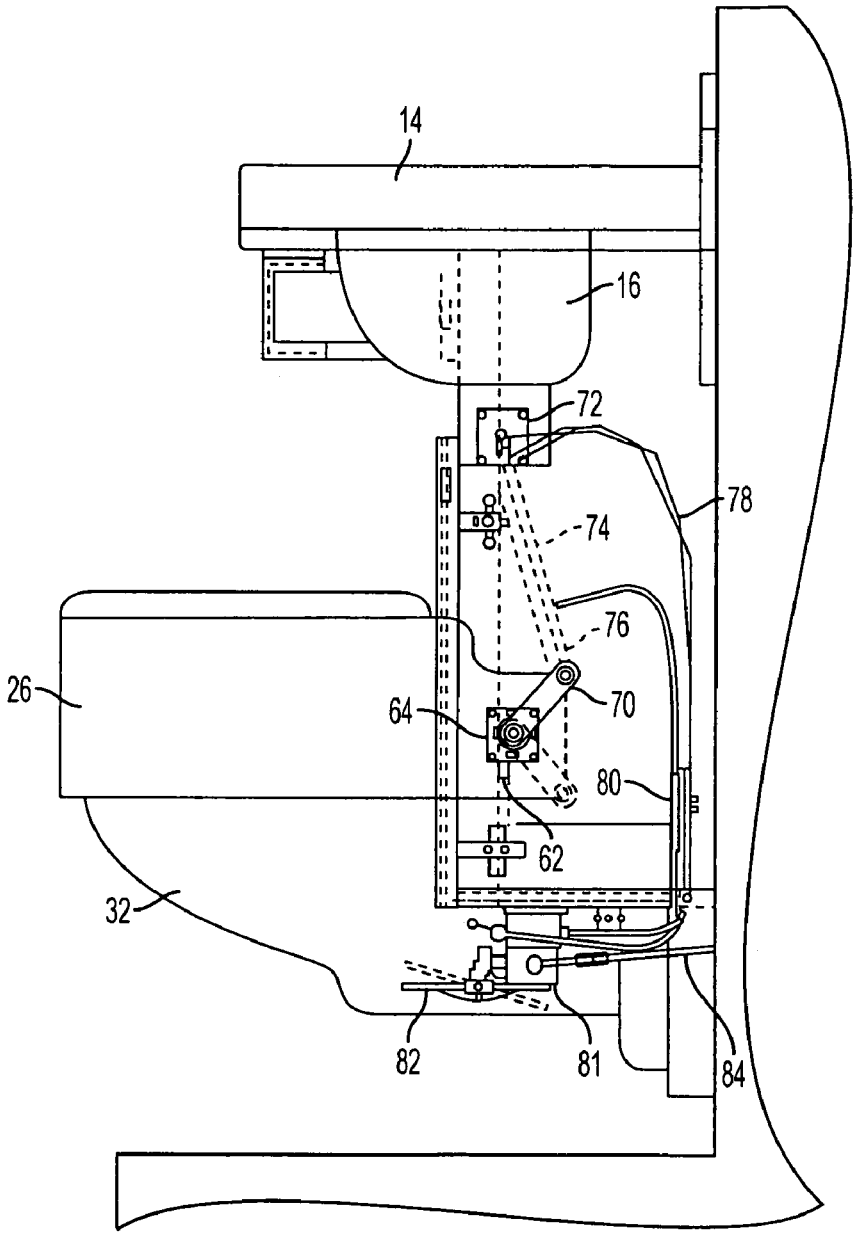
FIG. 4 is a view similar to FIG. 3 but showing the cover in the down position which puts the back panel in its forward position with the lifting/lowering device for the cover installed.

With reference to FIG. 3, it will be seen that the cover seat 26 is provided along its rear edge with one or more projections 42, which support a hinge 44 on which one edge of the back panel 27 is mounted. The hinge 44 may take the form of a "piano" hinge which is useful for its stability over long periods of use. The side walls 29 of the cover seat 26 may be provided with extensions on opposite sides as at 60 each of which will carry a plate 62 for each receiving a pivot pin 64 mounted on the opposite sides of the rim 35 of the bowl 32. The cover seat 26 will pivot on pins 64 until the back edge 66 engages the back portion 68 of the rim 35. Spaced from its upper edge 46, the back panel 27 along its side edges is provided with a pair of the spring-loaded pins 48, which engage tracks at 50, which are mounted or carried by the adjacent respective side walls 31 of the recess 30. With this arrangement, as the cover seat 26 is raised off of the toilet seat 34, the pins 48 will slide each along a track 50 mounted on the side wall of the recess 30 from the front of the recess 30 towards the end of the tracks 50 shown in FIG. 3. When the cover seat 26 is pivoted downwardly to the position shown in FIG. 1, the pins will ride along the respective tracks 50 to maintain the back panel 27 in an upright position as illustrated in FIG. 1. The back panel 27 is provided largely to improve the appearance of the cabinet unit 10 when the cover seat 26 is in its down position as shown in FIG. 4. The back panel 27 also serves as back support for anyone using the seat.

The cover seat 26 may be provided with padding on its upper surface as may the back panel 27, as shown at 52. Also, a handrail 54 may be provided on the counter 14 as is conventional in these types of units.

As shown in FIG. 4, a lifting and lowering device for the cover seat 26 may be installed inside the cabinet unit 10 and include a lever arm 70 which is rigidly attached to the pivot pin 64 which in turn is rigidly locked to the cover seat 26 so that movement of the lever arm 70 will be transmitted to the cover seat 26. The lever arm 70 has a distal end which is rotatably coupled in any conventional manner to the rod 76 of an hydraulic cylinder 74. One end of the cylinder 74 is pivotally mounted on a plate 72 attached in any suitable manner to the adjacent wall of the cabinet 10. Fluid conduits 78 and 80 communicate between opposite ends of the cylinder 74 to control the movement of a piston slidably disposed in the cylinder and attached to the inner end of the rod 76, as is conventional. A source of fluid under pressure such as tap water may be supplied through inlet conduit 84 to the valve 81. With this arrangement, to raise the cover seat 26, the valve 81 will be actuated to supply fluid under pressure to conduit 78 to thereby extend the piston rod 76 and move the lever 70 toward the dotted line position shown in FIG. 4. The cover seat 26 will correspondingly move toward its raised position. To lower a raised cover seat 26, the user will actuate the valve 82 to open conduit 78 to drain (not shown) and supply fluid under pressure to conduit 80 from source 84. A typical slide valve can be used in valve 81.

Figure 5:
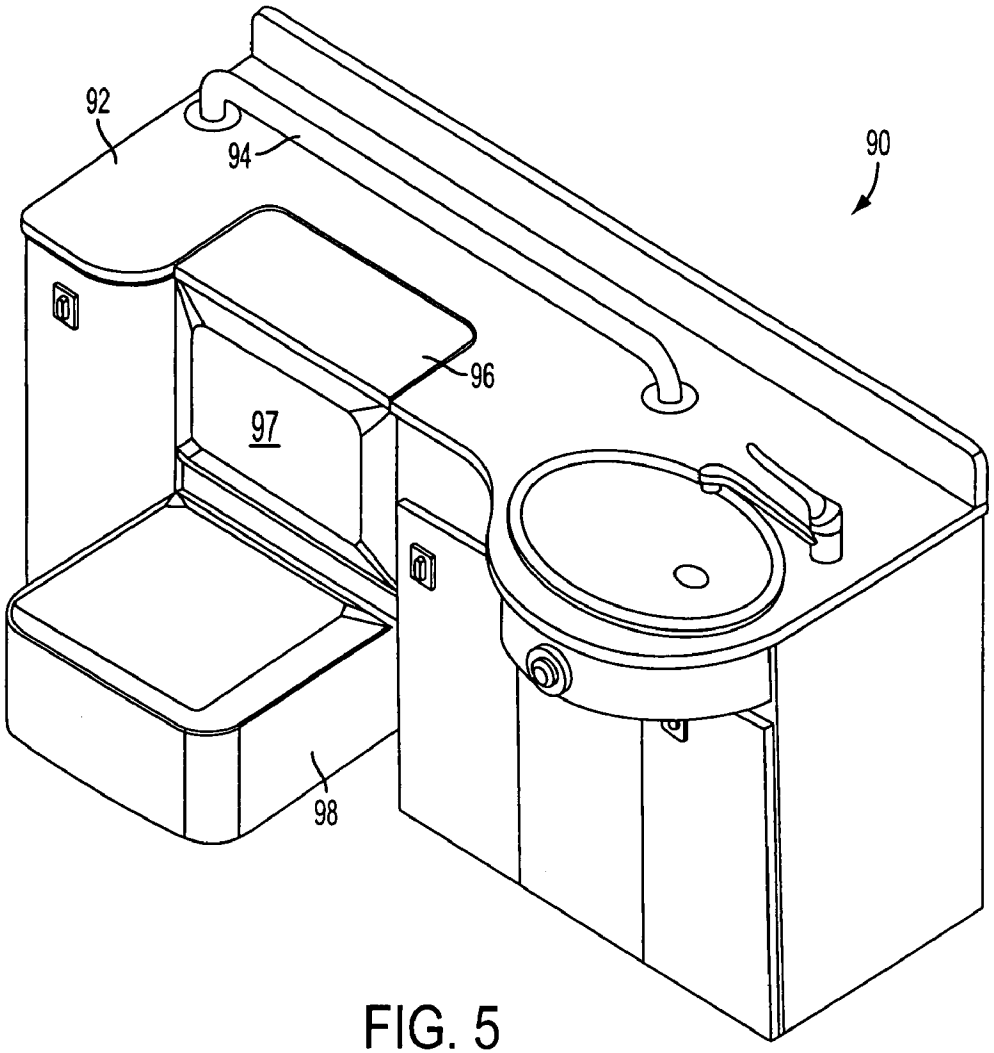
FIG. 5 is a perspective view of an alternate form of the invention.

Referring to drawing FIGS. 5-8, an alternative form of the invention is illustrated. In FIG. 5, a modified cabinet unit 90 is shown in perspective view. This form differs from that of the previous Figures in that the counter surface 92 is substantially flat and the hand rail 94 is substantially straight between its opposite ends which are secured to the counter surface 92 in any conventional manner. In addition, a movable surface portion 96 is provided and which is attached to the back portion 97 of the cover 98 as will be described below. The surface portion 96 is supported so that it will align perfectly flush with the counter surface 92 when the seat 98 is in its down or covering position for the toilet bowl shown in FIG. 8. In all other respects, the cabinet unit 90 may be the same as the structure described above in connection with FIGS. 1-4.

Figure 6:
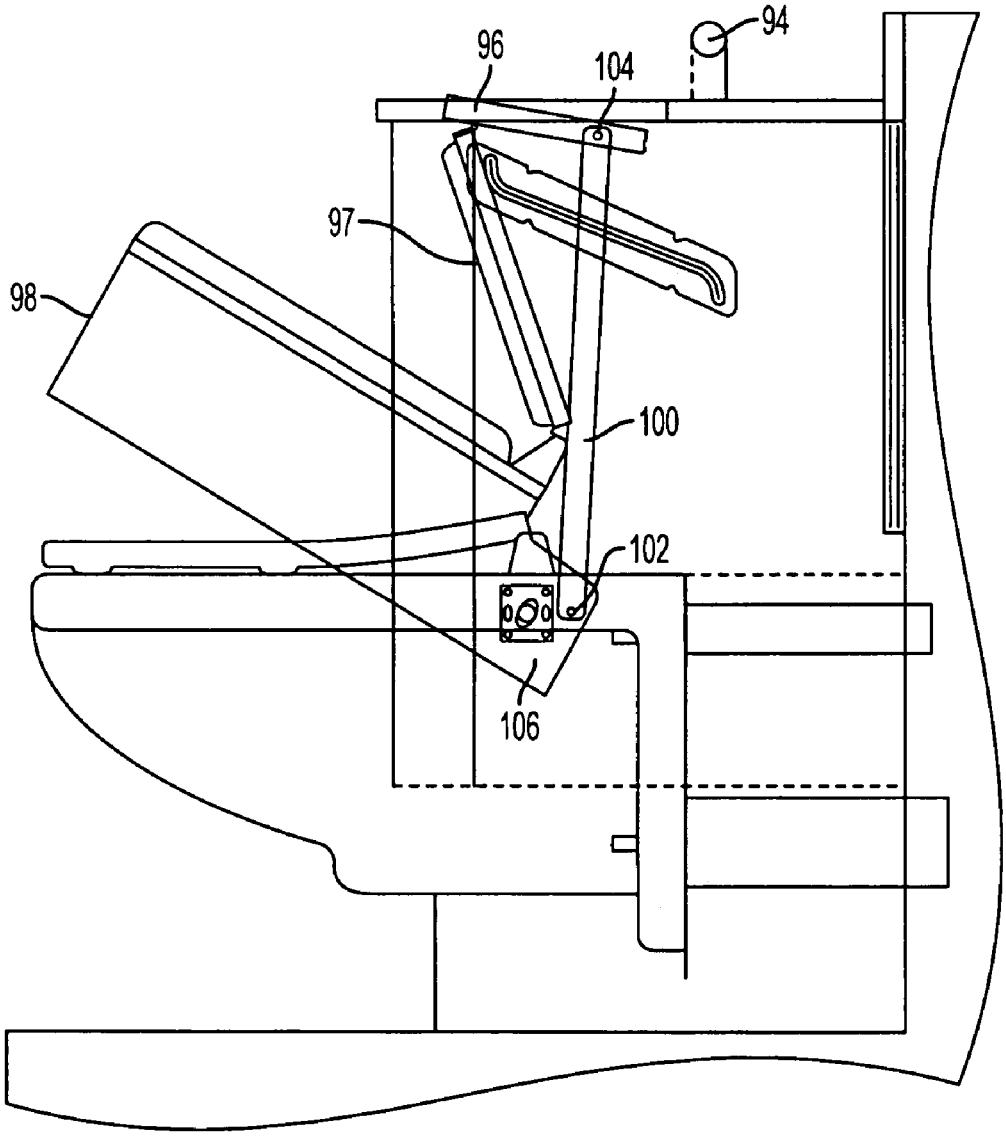
FIG. 6 is schematic view of the cover of FIG. 5 in a partially raised position.
Figure 7:
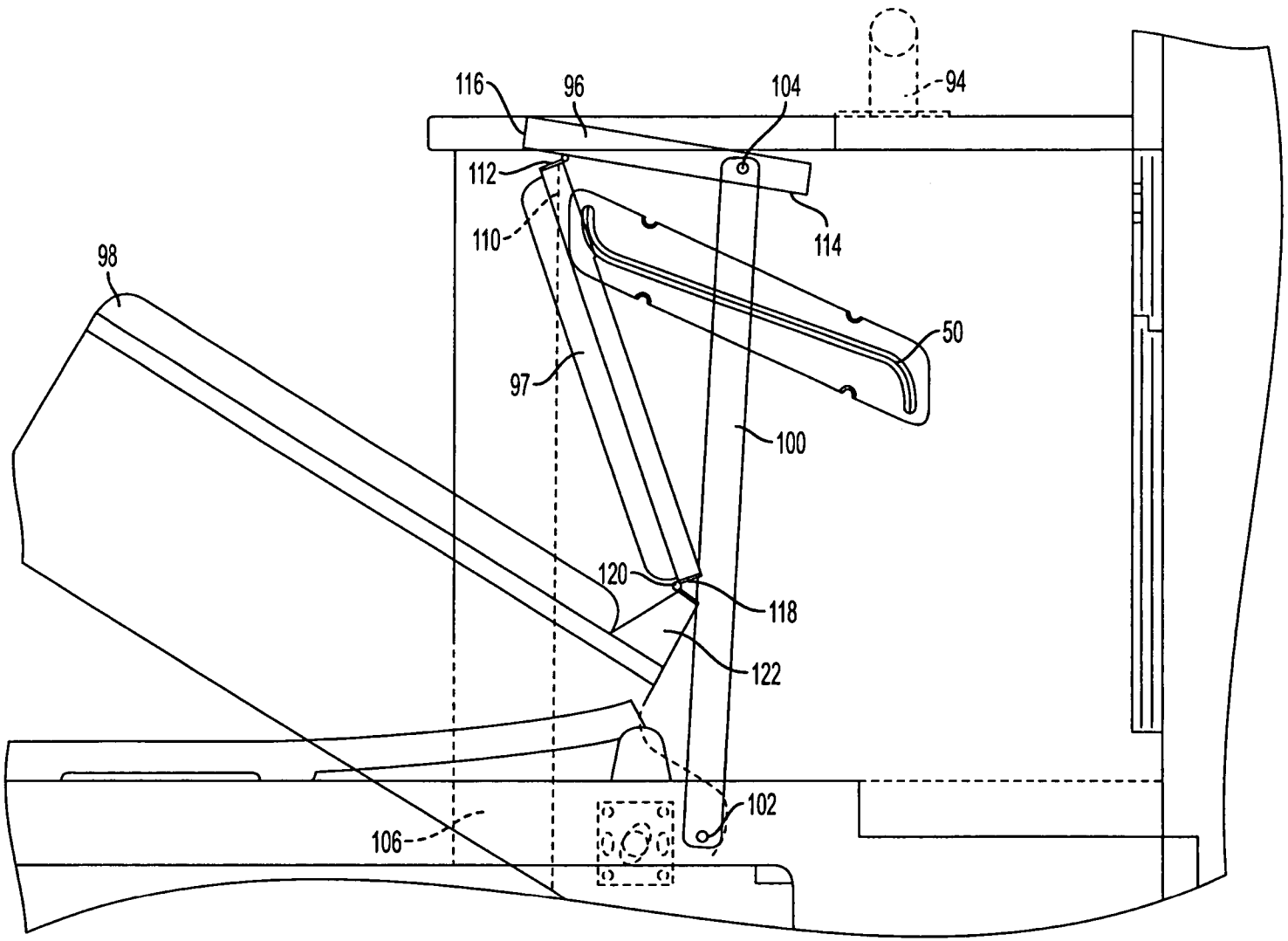
FIG. 7 is an enlarged view of the structure of FIG. 6.

With reference to FIGS. 6 and 7, when the seat is raised from its down position as shown in FIG. 5, the surface portion 96 will commence being retracted within the cabinet 90 by virtue of an arm of 100 which, it is lower end is pivotally attached as at 102 to the rear portion of the seat 98 and at its upper portion is pivotally attached to a side wall of the surface portion 96 as at 104. Thus, as the rear portion 106 of the seat 98 moves downwardly, the arm 100 will pull the rear of the surface portion 96 downwardly. As seen more clearly in FIG. 7, the upper end 110 of the back wall 97 of the seat 98 is hingedly attached as at 112 to the underside 114 of the surface portion 96 adjacent its forward edge 116. As in the previous embodiment, the lower edge 118 of the back wall 97 is handedly attached as at 120 to a pedestal 122 attached to the seat 98 along its rear edge. It will be evident, that, with this arrangement, the surface portion 96 is fully supported when the seat 98 is in its down position shown in FIG. 5 by both the arm 100 and the upper edge of the back wall 97 of the seat so that the surface portion 96 will be able to support articles thereon just as the adjacent counter surface 92.

Figure 8:
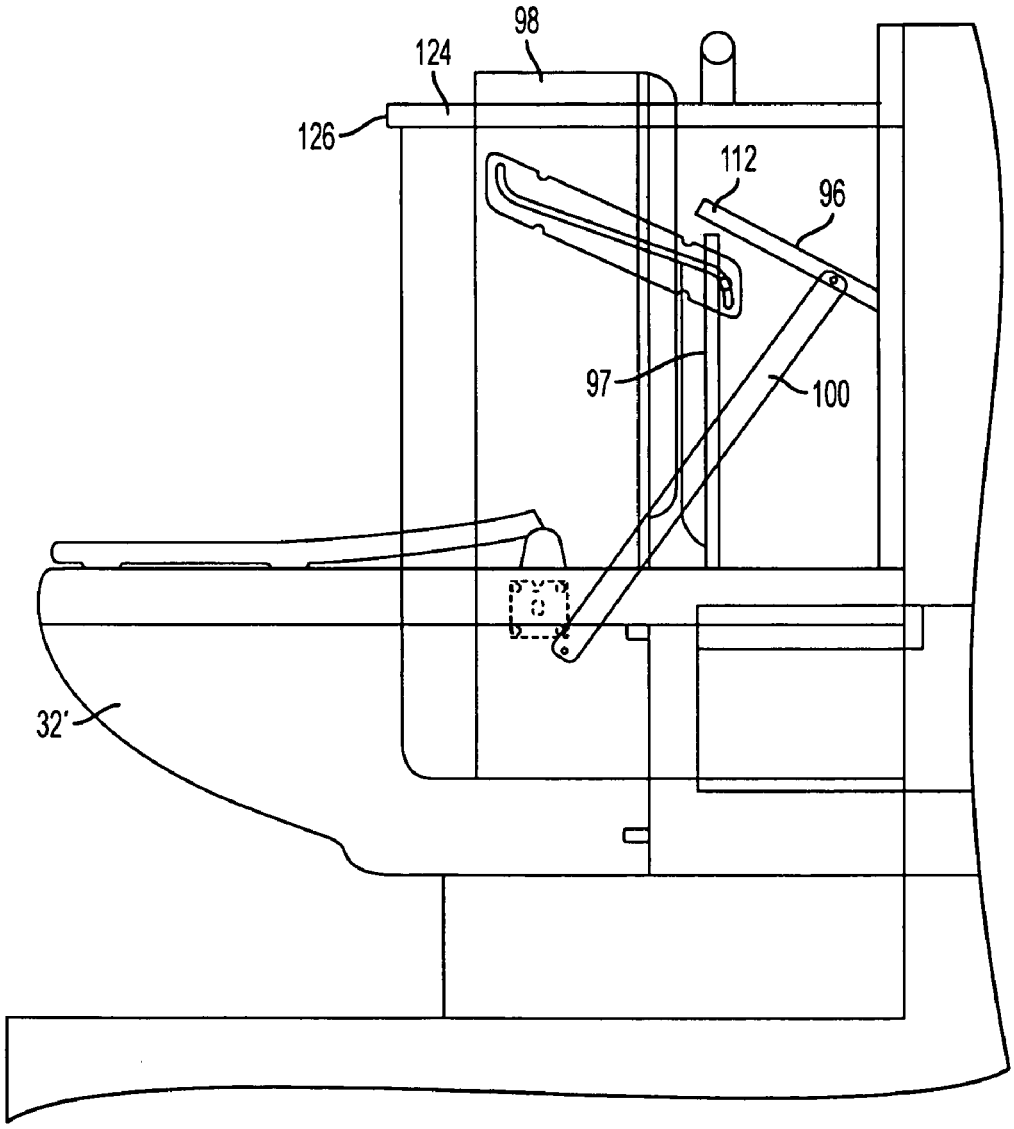
FIG. 8 is a schematic view of the cover of FIG. 6 in a fully raised position.

With reference to FIG. 8, there is shown the seat 98 in a fully up position with the surface portion 96 of the counter fully retracted within the cabinet 90. This will leave a recess 124 extending from the front edge 126 of the cabinet and into which the upper end of this seat 98 may be pivoted when it is necessary to use the toilet bowl 32'. Also, parallel arms 100 are used as major support for the surface portion 96. The surface portion 96 will also be supported by a continuous piano hinge 112 which will extend the full width of the surface portion 96 at the top edge of the back 97. A further advantage of the arrangement as shown in FIGS. 5-8 is that the height of the counter surface 92 may be lowered so as to accommodate wheelchair bound users without any modification of the toilet bowl dimensions thus resulting in a considerable saving in manufacturing costs. Also, although not shown, the hydraulic lifting mechanism of FIG. 4 can be employed with the structure of the embodiment of FIGS. 5-8 without any difficulty.

Having described the invention, it will be apparent, that various modifications may be made therein without departing from the spirit and scope of this invention.

What is claimed is:

1. A cover and cabinet for a toilet bowl having a pivotable rim defining an opening to said bowl, said cover having a seat portion for overlying the bowl and rim and including wall portions depending from portions of the seat portion on opposite sides of said bowl, said depending portions being pivotally attached on pivot pins to said bowl on the opposite sides thereof to allow said cover to pivot between a down position where said seat portion overlies said rim and an up position where the rim and bowl opening are exposed, said cabinet having facing side walls on opposite sides of said bowl, said seat portion having a rear section adjacent said pivot pins, said rear section supporting a hinge member, a back support having an upper section and a lower section with said lower section being pivotally attached to said hinge member, said upper section of said back support cooperating with tracks mounted on said opposite facing side walls of said cabinet and positioned so that said back portion will extend generally perpendicularly to said seat portion when said seat portion is in said down support.

2. The cover and cabinet as claimed in claim 1 wherein the back support includes spring loaded pins on opposite sides thereof, each for engaging a said track, along which said pin will ride as said cover is moved.

3. The cover and cabinet as claimed in claim 1 wherein the toilet bowl is provided with a lid pivotally attached to said toilet bowl and said seat portion has an inner wall facing said lid when in the down position, said inner wall including spacers for engaging said rim when said cover is in the down position.

4. The cover and cabinet as claimed in claim 1 wherein a pressure actuated device is provided to pivot said cover between said down and up positions.

5. The cover and cabinet as claimed in claim 4 wherein said pressure actuated device is a piston and cylinder with fluid conduits connecting the opposite sides of said piston to water under pressure though a valve member.

6. The cover and cabinet as claimed in claim 5, wherein said cabinet has an interior and said pressure actuated device is mounted in said interior and said valve member is mounted outside said cabinet.

7. The cover and cabinet as claimed in claim 6 wherein said valve member is a foot operated switch.

8. A cover and cabinet for a toilet bowl having a pivotable rim defining an opening to said bowl, said cover having a seat portion for overlying the bowl and rim and including wall portions depending from portions of the seat portion on opposite sides of said bowl, said depending portions being pivotally attached on pivot pins to said bowl on the opposite sides thereof to allow said cover to pivot between a down position where said seat portion overlies said rim and an up position where the rim and bowl opening are exposed, said cabinet having a top surface with said top surface formed with a recess receiving a movable panel portion, said movable panel portion having a top surface, a forward edge, a rearward edge and an underside surface, said seat portion having a rear section supporting a hinge member, a back support having an upper section and a lower section with said lower section being pivotally attached to said hinge member, said upper section of said back support being hingedly attached to said underside surface of said movable panel portion adjacent said forward edge of said panel portion, a support arm having one end pivotally attached to said movable panel portion adjacent said rearward edge thereof and an opposite end pivotally attached to a section of said seat portion, said back support and said support arm so that as said seat portion is moved from said down position toward said up position, said back support and said support arm will move said movable panel portion downwardly and rearwardly relative to said recess in said top surface of said cabinet to allow said seat portion to achieve a vertical position in said up position.

9. The cover and cabinet as claimed in claim 8 wherein a pair of support arms are provided, one on each side of said seat portion and each being attached to said removable panel on opposite sides thereof.

10. The cover and cabinet as claimed in claim 8 wherein said wall portions depending from portions of said seat portion having inner surfaces and said pivot pins being located on said inner surfaces.

11. The cover and cabinet as claimed in claim 9 wherein said wall portions have outer surfaces and said one ends of said support arms are pivotally attached to said outer surfaces of said wall portions.

* * * * *